United States Patent [19]

Li

[11] Patent Number: 4,929,212

[45] Date of Patent: May 29, 1990

[54] AERIAL TOY WITH ON-BOARD SIGNALING DEVICE

[75] Inventor: Shing-Lam Li, Tuen Mun, Hong Kong

[73] Assignee: Antibes, Inc., Monrovia, Liberia

[21] Appl. No.: 385,424

[22] Filed: Jul. 27, 1989

[51] Int. Cl.[5] ..... A63H 27/00

[52] U.S. Cl. ..... 446/47; 446/46; 273/424

[58] Field of Search ..... 446/96, 97, 48, 484, 446/485; 273/424, 425

[56] References Cited

U.S. PATENT DOCUMENTS

| | | | |
|---|---|---|---|
| 2,849,819 | 9/1958 | Murphy et al. | 446/485 X |
| 3,935,669 | 2/1926 | Potrzuki et al. | 446/485 |
| 3,948,523 | 4/1976 | Michael | 273/424 |
| 4,058,314 | 11/1977 | Wolf | 273/424 X |
| 4,086,723 | 5/1978 | Strawick | 446/47 |
| 4,133,528 | 1/1979 | Koblick | 446/485 X |
| 4,145,839 | 3/1979 | Sampietro | 446/47 |
| 4,255,895 | 3/1981 | LaBrecque | 446/47 |
| 4,563,160 | 1/1986 | Lee | 446/47 |

FOREIGN PATENT DOCUMENTS

| | | | |
|---|---|---|---|
| 33434 | 11/1964 | German Democratic Rep. | 446/485 |

*Primary Examiner*—Robert A. Hafer
*Assistant Examiner*—Sam Rimell
*Attorney, Agent, or Firm*—Kirschstein, Ottinger, Israel & Schiffmiller

[57] ABSTRACT

A saucer-shaped aerial toy has an on-board signaling device actuated only during flight by the closing of a pair of centrifugally-actuated electrical switches. The on-board signalling device may generate sound and/or light which not only have recreational value, but also serve as early warning indicators that the aerial toy is in the vicinity.

8 Claims, 1 Drawing Sheet

AERIAL TOY WITH ON-BOARD SIGNALING DEVICE

BACKGROUND OF THE INVENTION

1. Field of the Invention

This invention generally relates to a flying saucer toy having an aerodynamic characteristic enabling it to spin and to travel considerable distances when thrown into the air and, more particularly, to such an aerial toy having an on-board signaling device which is only reliably actuated during flight.

2. Description of Related Art

U.S. Pat. No. 3,359,678 discloses a flying saucer toy for toss games and the like. To add interest to the use of such a flying toy, battery-powered lights have been mounted thereon, usually at the periphery thereof, as disclosed, for example, in U.S. Pat. Nos. 4,435,917 or 4,563,160. To prevent rapid battery drain, a single centrifugally-actuated switch is employed, as suggested by U.S. Pat. No. 3,798,834, for actuating a battery-powered light or buzzer during flight.

Experience has shown, however, that the use of a single centrifugally-actuated switch to actuate a light or buzzer on board the aerial toy is not altogether desirable. Such a centrifugal switch typically has a movable switch contact which is spring-biased away from the light or buzzer. The spring bias is relatively weak so that it may readily be overcome by centrifugal force generated during flight. However, over time, and particularly after the aerial toy has been subjected to repeated shocks as a result of impacting against obstacles in the flight path over extended use, the spring bias becomes even weaker. As a result, sometimes the force of gravity alone is sufficient to move the movable switch contact, thereby actuating the light or buzzer when the toy is not in flight but is merely being held or stored in a vertical plane. This leads to rapid battery drain and frequent battery replacement.

SUMMARY OF THE INVENTION

1. Objects of the Invention

It is a general object of this invention to provide an aerial toy with an on-board signaling device that is operative only when the toy is in flight.

It is another object of this invention to provide such an aerial toy whose on-board signaling device is actuated only by centrifugal force and not by the force of gravity acting when the toy is held or stored in a vertical plane.

Another object of this invention is to provide a battery-powered signaling device having a long battery working lifetime.

A further object of this invention is to avoid frequent battery replacement in such aerial toys.

Still another object of this invention is to provide a novel aerial toy which is highly recreational and safe.

Yet another object of this invention is to provide such an aerial toy with a reliable on-board signaling device capable of alerting innocent passersby of the approach of the toy.

2. Features of the Invention

In keeping with these objects, and others which will become apparent hereinafter, one feature of this invention resides, briefly stated, in an aerial toy of the type having a disc-shaped body having a central axis. When the body is hurled into the air, it spins around the central axis in a sustained flight and travels a considerable distance. Centrifugal force is generated during such flight.

The toy comprises an actuatable electrically-powered signaling means, for example, a buzzer and/or a light, supported by the body. The signaling means is operative for producing a distinctive signal, e.g. sound and/or light, when actuated. A battery is supported by the body and is operative for supplying electrical power for the signaling means.

According to this invention, means are provided for actuating the signaling means only during flight. Such actuating means includes a pair of centrifugally-actuated electrical switches both located off the central axis on the body. Both switches are switchable simultaneously between first switched states and second switched states. In the first switched states, both switches are normally open, and the battery is electrically disconnected from the signaling means. In the second switched states, both switches are closed, and the battery is electrically connected to the signaling means for actuating the same and producing said distinctive signal only during flight.

Both switches are electrically connected in series with each other and with the battery and signaling means. Thus, both switches must be closed in order to actuate the switching means during flight. This event can only occur during flight when the centrifugal force acts to close both switches. This event cannot happen when the disc-shaped body is held or stored in a generally vertical orientation because gravity, at best, can only close one of said switches, but not both.

In a preferred embodiment, each switch includes a stationary contact, a movable contact, and a weight movable along a guide toward and away from a respective movable contact to urge the latter into engagement with a respective stationary contact under the influence of the centrifugal force. The weights of both switches move radially away from each other in opposite directions along a common line during flight.

When the signaling means is advantageously constituted as a buzzer, a continuous or pulsing sound is generated during flight of the toy. Such a "singing" saucer enables one to follow its flight even at night, and also serves as an early warning signal to innocent passersby of the approach of the aerial toy.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
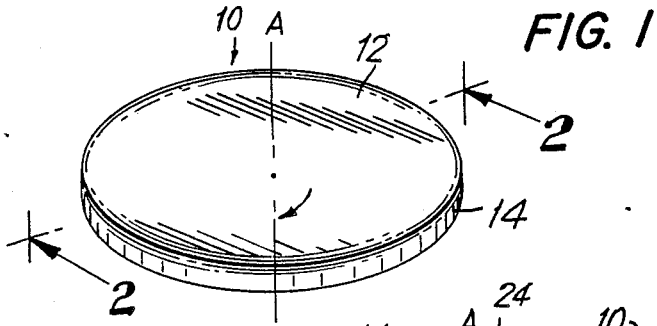
FIG. 1 is a front perspective view of an aerial toy according to this invention.
Figure 2:
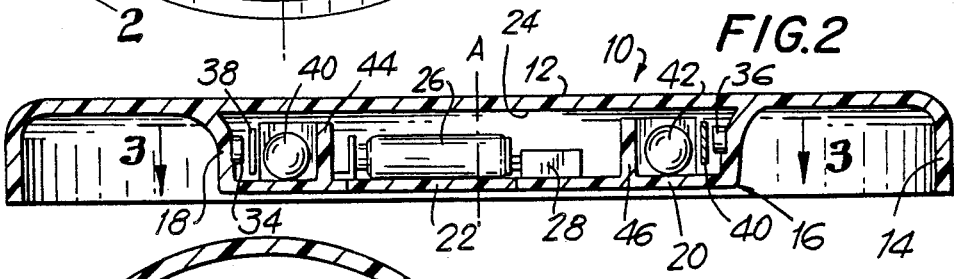
FIG. 2 is an enlarged sectional view taken on line 2—2 of FIG. 1.

Referring now to FIGS. 1 and 2, reference numeral 10 generally identifies the aerial toy according to this invention, having a disc- or saucer-shaped body 12 whose outer edge is formed as a peripheral skirt 14. A central pocket 16 is shown as being molded at the center and underside of the body 12. The pocket 16 has a cylindrical side wall 18 and a base wall 20 in which an openable door 22 is pivotably mounted. The walls 18, 20 bound an interior space 24, access to which may be had through the door 22. Rather than a molded pocket, a discrete cylindrical housing can be mounted by suitable fasteners to the underside of the body in a variant construction. The body 12 has a central axis A about which it spins in a sustained flight when the body is hurled into the air by a rapid flick of one's wrist. Centrifugal forces acting outwardly of the central axis are thereby generated during such flight.

Figure 3:
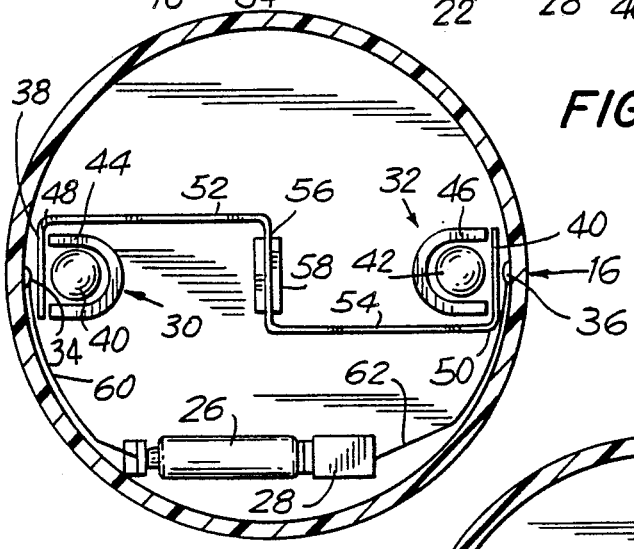
FIG. 3 is a sectional view taken on line 3—3 of FIG. 2 in a normal or rest position of the toy.
Figure 4:
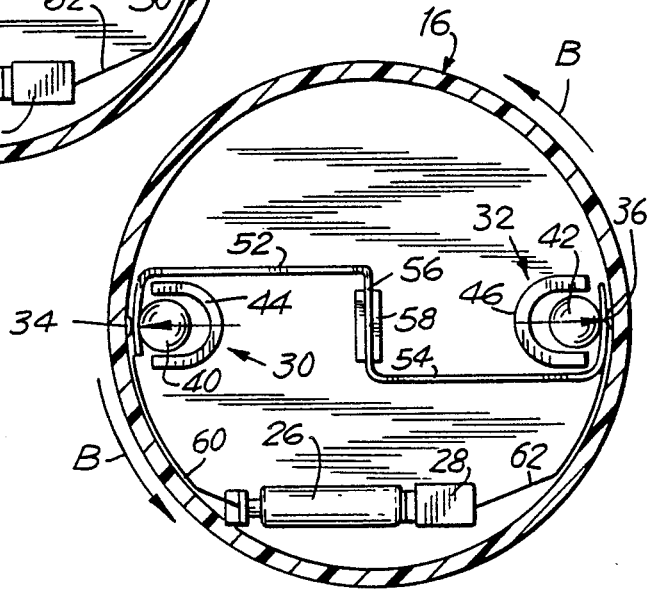
FIG. 4 is a view similar to FIG. 3, but in a flight position.

Within the pocket 16, as best shown in FIGS. 3 and 4, are mounted a battery 26, and a signaling device 28 such as a battery-powered buzzer and/or light mounted on a printed circuit board. Two centrifugally-actuated electrical switches 30, 32 are mounted within the pocket diametrically opposite each other and equidistant from the central axis. Switches 30, 32 respectively have stationary contacts 34, 36, and movable contacts 38, 40, the latter advantageously constituted as planar leaf springs which are normally biased away from the stationary contacts. Switches 30, 32 also have respective ball-shaped weights 40, 42 rollable along U-shaped guides 44, 46. The open ends of the guides 44, 46 face the springs 38, 40. The opposite ends of the guides are closed to limit movement of the weights toward the central axis.

The leaf springs 38, 40 are pivotably movable about hinges 48, 50. An electrically-conductive support having legs 52, 54 and an intermediate transverse web 56 extending between, and perpendicularly to, the legs 52, 54 is connected between the springs 38, 40. The support can be replaced by an electrical wire. The web 56 is frictionally retained in a slotted mount 58, thereby easily fixing the normal positions of the springs 38, 40 between, and spaced from, a respective stationary contact 34 or 36 and a respective weight 40 or 42. The stationary contact 34 is electrically connected by conductive wire 60 to the anode of the battery 26. The cathode of the battery 26 is electrically connected to one side of the signaling device 28, the opposite side of which is, in turn, electrically connected by conductive wire 62 to the other stationary contact 36. An electrical circuit is thus formed as the series connection of the battery 26, signaling device 28, and the two switches 30, 32.

As best shown in FIG. 3, the switches in their normal or rest condition are normally open, thereby preventing electrical current from the battery from reaching and actuating the signaling device. When the body is spun in flight, for example, in the direction of the curved arrows B in FIG. 4, the resulting centrifugal forces urge the weights 40, 42 in opposite directions along a common line passing through the center of the toy. The weights push against the springs 38, 40 with sufficient force to urge the same into conductive engagement with the stationary contacts 34, 36, thereby closing switches 30, 32. The closing of both switches completes the electrical circuit and allows electrical current from the battery to flow to the signaling device to actuate the same.

Thus, both switches 30, 32 must be closed, and preferably simultaneously, in order to actuate the signaling device 28. Even if one were to hold the toy in a generally vertical orientation, thereby causing one of the weights, e.g. 40, to descend and push the spring 38 against the stationary contact 34, thereby closing switch 30, the other switch 32 would remain open since the weight 42 would be positioned far awaY from its respective spring 40 and its stationary contact 36. Reliable actuation of the signaling device occurs only during flight, thereby minimizing battery drain and battery replacement.

When the signaling device is a buzzer, a sound will be generated during flight. The sound may be continuous or pulsed, and may be a single tone or a succession of tones. The sound enables one to follow the path of the toy even at night.

The sound can also be used as a warning to alert innocent passersby that an aerial toy is approaching, thereby giving the passersby sufficient time to avoid the incoming toy. This feature is of particular benefit at the beach where toss games involving such aerial toys are a common recreational activity.

In the case where the signaling device is a light, here, again, the lights serve as an early warning that such an aerial toy is approaching, and is of particular benefit to protect innocent passersby at night.

It will be understood that each of the elements described above, or two or more together, also may find a useful application in other types of constructions differing from the types described above.

While the invention has been illustrated and described as embodied in an aerial toy with on-board signaling device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An aerial toy, comprising:

(a) a disc-shaped body having a central axis about which the body spins in a sustained flight when the body is hurled into the air, thereby generating centrifugal force;

(b) an actuatable, electrically-powered signaling means supported by the body, and operative for producing a distinctive signal when actuated;

(c) a battery supported by the body, and operative for supplying electrical power for the signaling means; and (d) means for actuating the signaling means only during flight, including a pair of centrifugally-actuated electrical switches both located off the central axis on the body, both switches being switchable substantially simultaneously between first switched states in which the battery is electrically disconnected from the signaling means, and second switched states in which the battery is electrically connected to the signaling means for actuating the same and producing said distinctive signal only during flight, said switches being mounted diametrically opposite each other and equidistant from the central axis, each switch including a stationary contact, a movable contact, and a pushing means for pushing a respective movable contact into engagement with a respective stationary contact under the influence of the centrifugal force, each movable contact being a resilient arm normally biased away from a respective stationary contact.

2. The aerial toy according to claim 1, wherein the signaling means is an auditory annunciator for producing sounds.

3. The aerial toy according to claim 1, wherein each pushing means includes a weight movable along a guide toward and away from a respective movable contact.

4. The aerial toy according to claim 3, wherein the weights of both pushing means move radially away from each other in opposite directions along a common line during flight.

5. The aerial toy according to claim 3, wherein each guide has a stop wall to limit movement of a respective weight.

6. The aerial toy according to claim 1, wherein each resilient arm is a leaf spring.

7. The aerial toy according to claim 1, wherein both switches are electrically connected in series with each other and with the battery and the signaling means.

8. The aerial toy according to claim 7, wherein both switches are normally open in said first switched states, and are closed in said second switched states.

* * * * *